US006836252B2

(12) United States Patent
Tai et al.

(10) Patent No.: US 6,836,252 B2
(45) Date of Patent: Dec. 28, 2004

(54) DUAL-FREQUENCY INVERTED-F ANTENNA

(75) Inventors: Lung-Sheng Tai, Tu-Chen (TW); Hsien-Chu Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/299,455

(22) Filed: Nov. 18, 2002

(65) Prior Publication Data

US 2003/0234742 A1 Dec. 25, 2003

(30) Foreign Application Priority Data

Jun. 20, 2002 (TW) ..... 91209272 U

(51) Int. Cl.[7] ..... H01Q 1/24
(52) U.S. Cl. ..... 343/702; 343/700 MS
(58) Field of Search ..... 343/702, 700 MS, 343/846, 895, 848; H01Q 1/24

(56) References Cited

U.S. PATENT DOCUMENTS 6,002,367 A 12/1999 Engblom et al.
6,072,434 A 6/2000 Papatheodoron
6,252,552 B1 6/2001 Tarvas et al.
6,456,243 B1 * 9/2002 Poilasne et al. ..... 343/700 MS
6,473,043 B1 * 10/2002 Hwang ..... 343/702
6,567,053 B1 * 5/2003 Yablonovitch et al. ..... 343/767

OTHER PUBLICATIONS

Ming–Sze Tong et al. "Finite–Difference Time–Domain Analysis of a Stacked Dual–Frequency Microstrip Planar Inverted–F Antenna for Mobile Telephone Handsets", IEEE Transaction on Antenna and Propagation, vol. 49, No. 3, Mar. 2001, 367–376.

Yinchao Chen, "Design and Analysis of a Stacked DualFrequency Planar Inverted–F Antenna for Mobil Telephone Handsets", Report of University of South Carolina, Aug. 2001, http//www.ee.sc.edu/classes/Fallo1/elct861/df–pi-fa.ppt.

* cited by examiner

*Primary Examiner*—Hoanganh Le
(74) *Attorney, Agent, or Firm*—Wei Te Chung

(57) ABSTRACT

A dual-frequency inverted-F antenna (PIFA) (1) for an electronic device has a ground plane (13), a first radiating patch (11) parallel to the ground plane, a second radiating patch (12) parallel to the first radiating patch, and a first and second connecting portions (111, 121) respectively connecting the first and second radiating patches with the ground plane. The first radiating patch and the ground plane constitute a first frequency resonant structure, and the first and second radiating patches constitute a second frequency resonant structure.

16 Claims, 7 Drawing Sheets

| Gain / Frequency | Max.Gain(dBi) | Avg.Gain(dBi) |
|---|---|---|
| 2.40GHz | -2.13 | -8.358 |
| 2.45GHz | -1.27 | -7.722 |
| 2.50GHz | -0.68 | -7.44 |

| Gain / Frequency | Max.Gain(dBi) | Avg.Gain(dBi) |
|---|---|---|
| 2.40GHz | 0.95 | -3.3 |
| 2.45GHz | 0.94 | -3.036 |
| 2.50GHz | 0.95 | -2.96 |

| Gain / Frequency | Max.Gain(dBi) | Avg.Gain(dBi) |
|---|---|---|
| 5.15GHz | -5.47 | -11.52 |
| 5.25GHz | -5.29 | -11.15 |
| 5.35GHz | -5.89 | -12.09 |

| Gain / Frequency | Max.Gain(dBi) | Avg.Gain(dBi) |
|---|---|---|
| 5.15GHz | -0.48 | -3.147 |
| 5.25GHz | -0.6 | -3.348 |
| 5.35GHz | -1.72 | -4.498 |

DUAL-FREQUENCY INVERTED-F ANTENNA

CROSS-REFERENCE TO RELATED APPLICATION

This application relates to a application, patent application Ser. No. 10/037,721, entitled "DUAL-FREQUENCY ANTENNA WITH BENDING STRUCTURE", now U.S. Pat. No. 6,577,278, assigned to the same assignee as the present invention.

BACKGROUND OF THE INVENTION

1. Field of the Invention

The present invention relates to an antenna, and in particular to an inverted-F antenna (PIFA) having two different antenna architectures, thus operating at two distinct frequencies.

2. Description of the Prior Art

There is a growing need for dual-frequency antennas for use in wireless communication devices to adapt the devices for dual-frequency operation. For example, the transition of application frequency from 2.45 GHz (IEEE802.11b) to 5.25 GHz (IEEE802.11a) requires an antenna which operates at both frequencies, rather than two single frequency antennas. U.S. Pat. No. 6,252,552 discloses several conventional dual-frequency planar antennas (shown in FIGS. 4–12).

However, each of those conventional dual-frequency planar antennas has a substantially planar structure, which requires relative more mounting surface for installation in an electronic device.

Hence, an improved antenna is desired to overcome the above-mentioned shortcoming of existing antennas.

BRIEF SUMMARY OF THE INVENTION

A primary object, therefore, of the present invention is to provide an inverted-F antenna (PIFA) antenna with two different antenna architectures for operating at two distinct frequencies.

A dual-frequency inverted-F antenna (PIFA) in accordance with the present invention for an electronic device comprises a ground plane, a first radiating patch parallel to the ground plane, a second radiating patch parallel to the first radiating patch, and a first and second connecting portions respectively connecting the first and second radiating patches with the ground plane. A coaxial cable feeder has a conductive inner core wire and a conductive outer shield. The inner core wire is electrically connected to the first radiating patch and the outer shield is electrically connected to the ground plane. The first radiating patch and the ground plane constitute a first frequency resonant structure, and the first and second radiating patches constitute a second frequency resonant structure.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
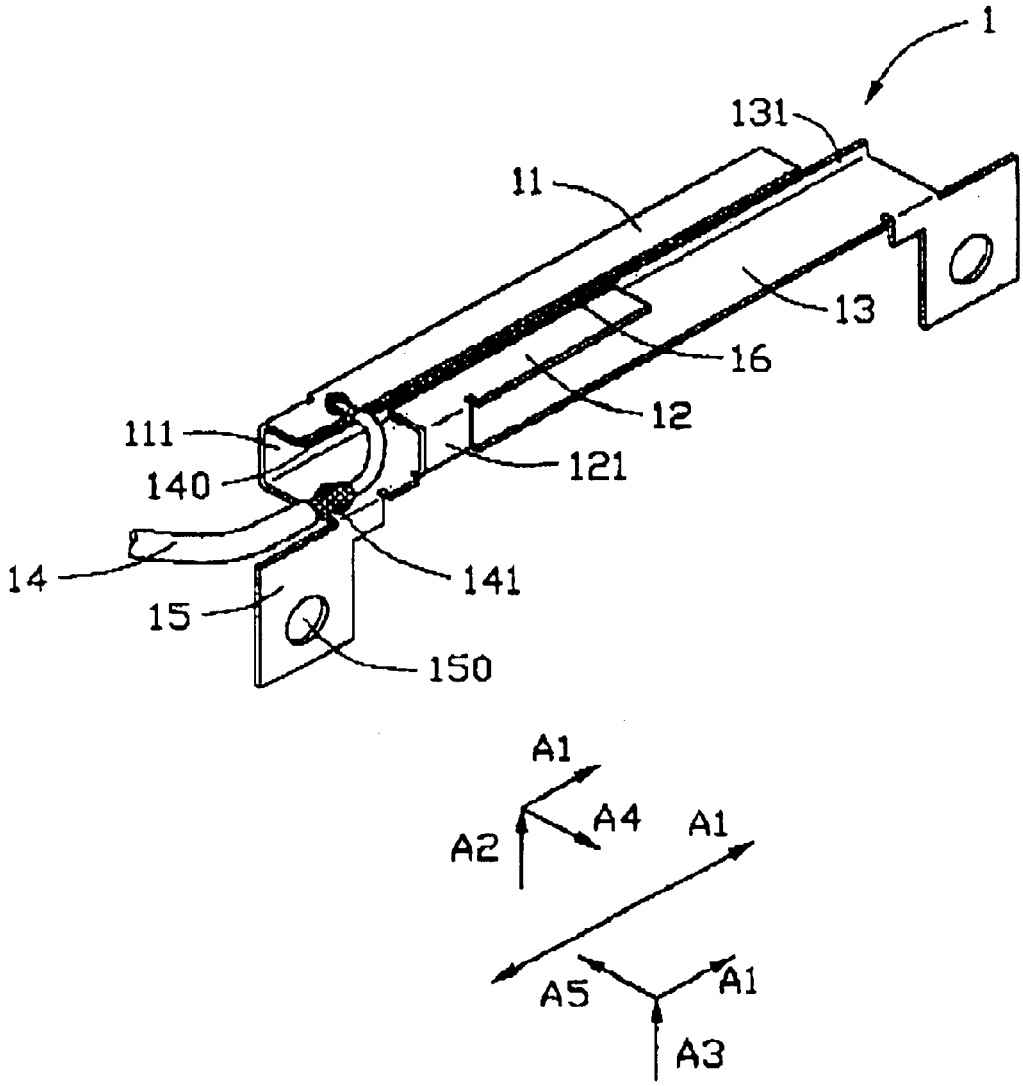
FIG. 1 is a perspective view of a preferred embodiment of a dual-frequency antenna in accordance with the present invention, with a coaxial cable electrically connected thereto.
Figure 2:
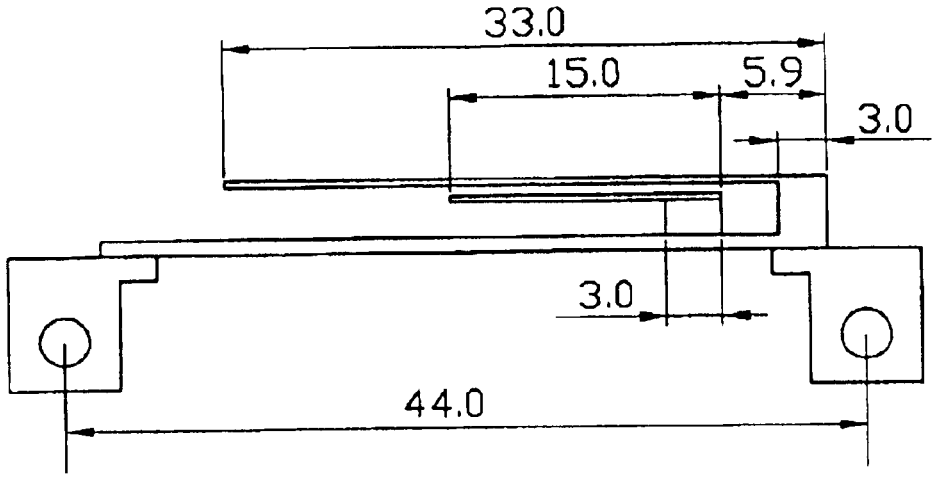
FIG. 2 is a rear view of the antenna of FIG. 1, illustrating some dimensions of the dual-frequency antenna of FIG. 1.
Figure 3:
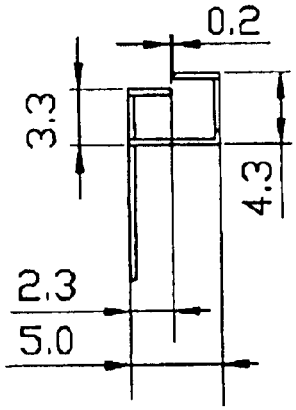
FIG. 3 is a distal end view of the antenna of FIG. 1, illustrating other dimensions of the dual-frequency antenna of FIG. 1.
Figure 4:
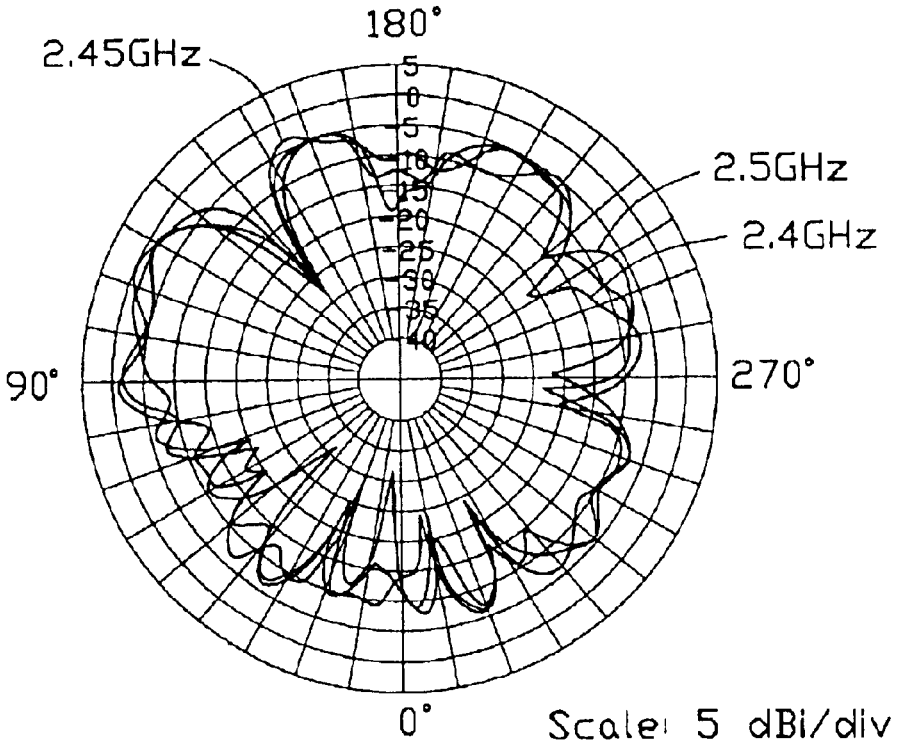
FIG. 4 is a group of horizontally polarized principle plane radiation patterns of the dual-frequency antenna of FIG. 1 operating at frequencies of 2.4 GHz, 2.45 GHz and 2.5 GHz.
Figure 5:
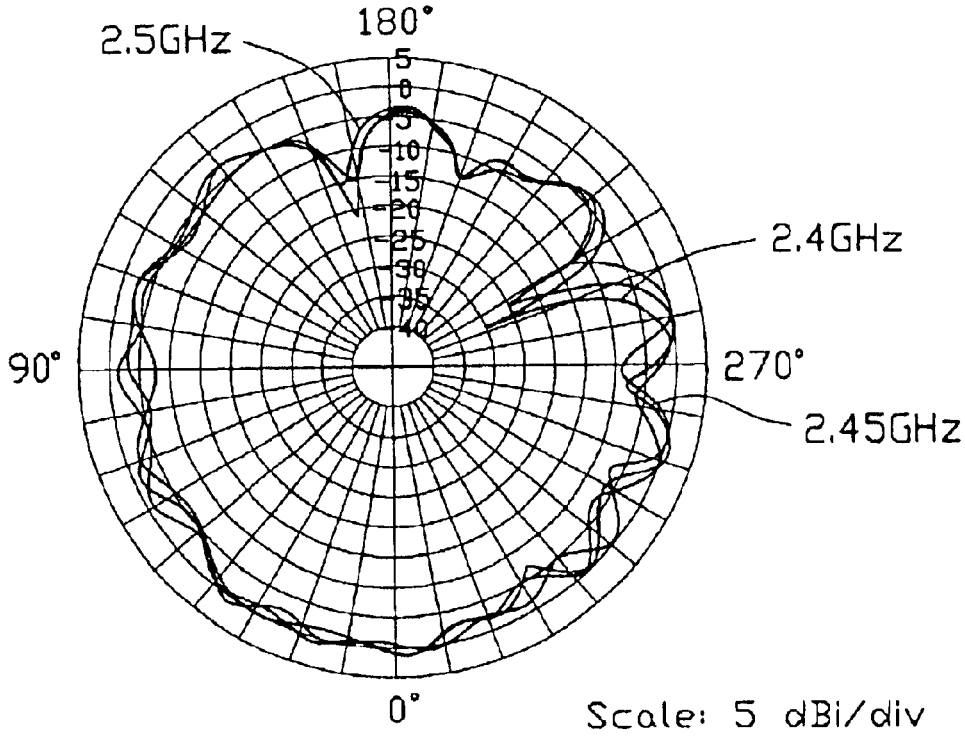
FIG. 5 is a group of vertically polarized principle plane radiation patterns of the dual-frequency antenna of FIG. 1 operating at frequencies of 2.4 GHz, 2.45 GHz and 2.5 GHz.
Figure 6:
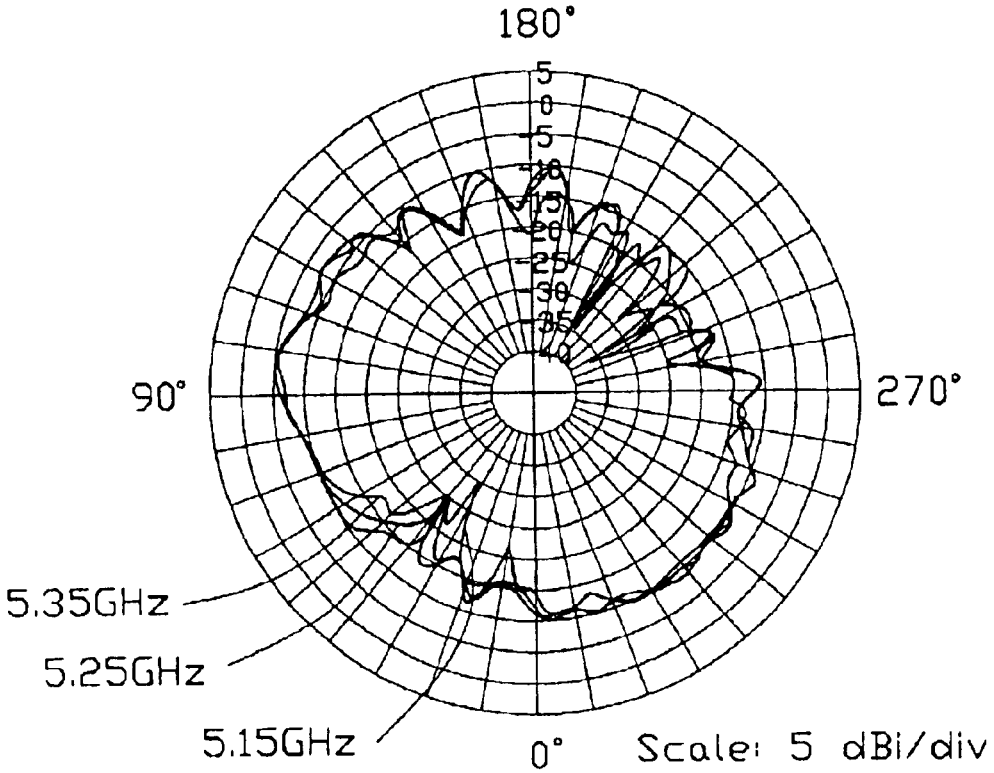
FIG. 6 is a group of horizontally polarized principle plane radiation patterns of the dual-frequency antenna of FIG. 1 operating at frequencies of 5.15 GHz, 5.25 GHz and 5.35 GHz.
Figure 7:
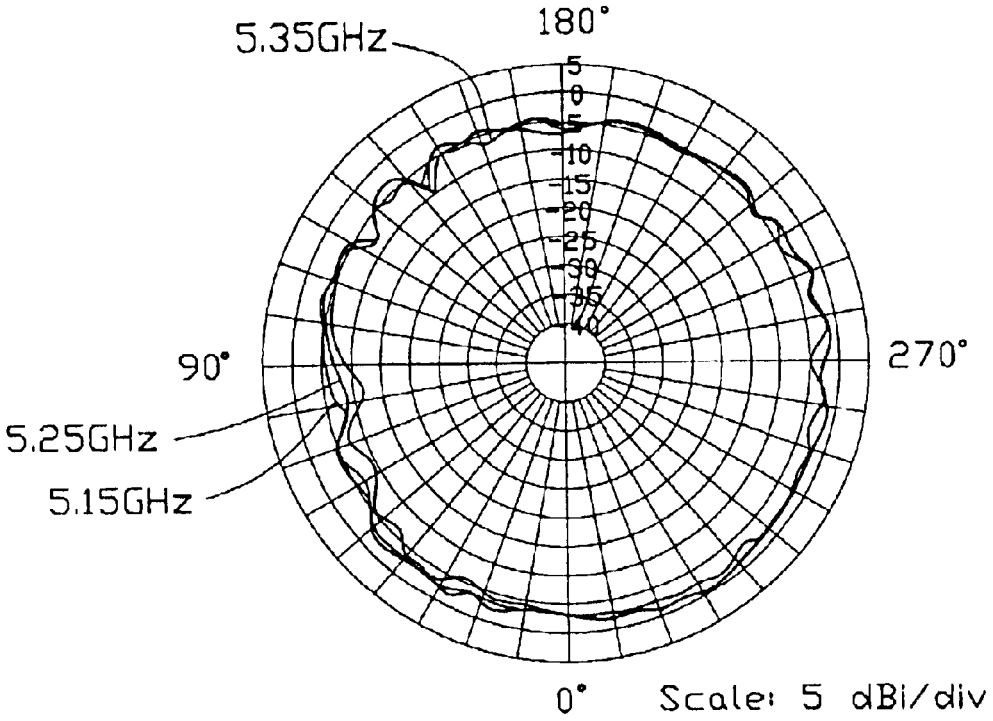
FIG. 7 is a group of vertically polarized principle plane radiation patterns of the dual-frequency antenna of FIG. 1 operating at frequencies of 5.15 GHz, 5.25 GHz and 5.35 GHz.

Referring to FIGS. 1, 2 and 3, a dual-frequency inverted-F antenna (PIFA) 1 in accordance with the present invention is made from a metal foil, and comprises a conductive ground plane 13, a first radiating patch 11, a second radiating patch 12 and a pair of mounting patches 15.

Particularly referring to FIG. 1, the ground plane 13 has a substantially elongated rectangular shape and extends in a longitudinal direction that is in a first direction indicated by an arrow A1. An assistant edge 131 bends upwardly from a rear edge of the ground plane 13. A first connecting portion 111 extends upwardly (that is in a second direction indicated by an arrow A2) from a proximal end portion of the assistant edge 131 and connects to a rear edge of a proximal end portion of the first radiating patch 11. The first radiating patch 11 bends forwardly (that is in a fourth direction indicated by an arrow A4) from the first connecting portion 111 and extends longitudinally (that is in the first direction A1) in a distal direction, parallel to the ground plane 13. A second connecting portion 121 extends upwardly (that is a third direction indicated by an arrow A3) from a front edge of a proximal end portion of the ground plane 13 and connects to a front edge of a proximal end portion of the second radiating patch 12. The second radiating patch 12 bends rearwardly (that is a fifth direction indicated by an arrow A5) from the second connecting portion 121 and extends longitudinally (that is in the first direction A1) in a distal direction, parallel to the ground plane 13.

The first and second radiating patches 11, 12 are parallel to each other. An aperture 16 is defined between the first and second radiating patches 11, 12 both in the horizontal and vertical directions. Detailed dimensions of the dual-frequency PIFA 1 are particularly shown in FIGS. 2 and 3.

A coaxial feeder cable 14 comprises a conductive inner core 140, a dielectric layer (not labeled) and a conductive outer shield 141 over the dielectric layer. The inner core 140 is soldered onto a top surface of the proximal end portion of the first radiating patch 11, and the outer shield 141 is soldered onto a top surface of the proximal end portion of the ground plane 13.

In assembly, the dual-frequency PIFA 1 is assembled in an electrical device, such as a laptop computer (not shown), by the mounting patches 15. The ground plane 13 is grounded. RF signals are fed to the dual-frequency PIFA 1 by the conductive inner core 140 of the coaxial cable 14 and the conductive outer shield 141.

The first radiating patch 11 and the ground plane 13 constitute a low-frequency resonant structure, operating around 2.45 GHz. The first and second radiating patches 11, 12 taken together constitute a high-frequency resonant structure, operating around 5.25 GHz. The first and second radiating patches 11, 12 constitute nearly independent regions having different resonant frequencies. This is an advantage where the dual-frequency PIFA must operate in different environments.

FIGS. 4–7 respectively show horizontally and vertically polarized principle plane radiation patterns of the dual-frequency PIFA 1 operating at frequencies of 2.4 GHz, 2.45 GHz, and 2.5 GHz, and at 5.15 GHz, 5.25 GHz, and 5.35 GHz. Note that each radiation pattern is close to a corresponding optimal radiation pattern.

Figure 8:
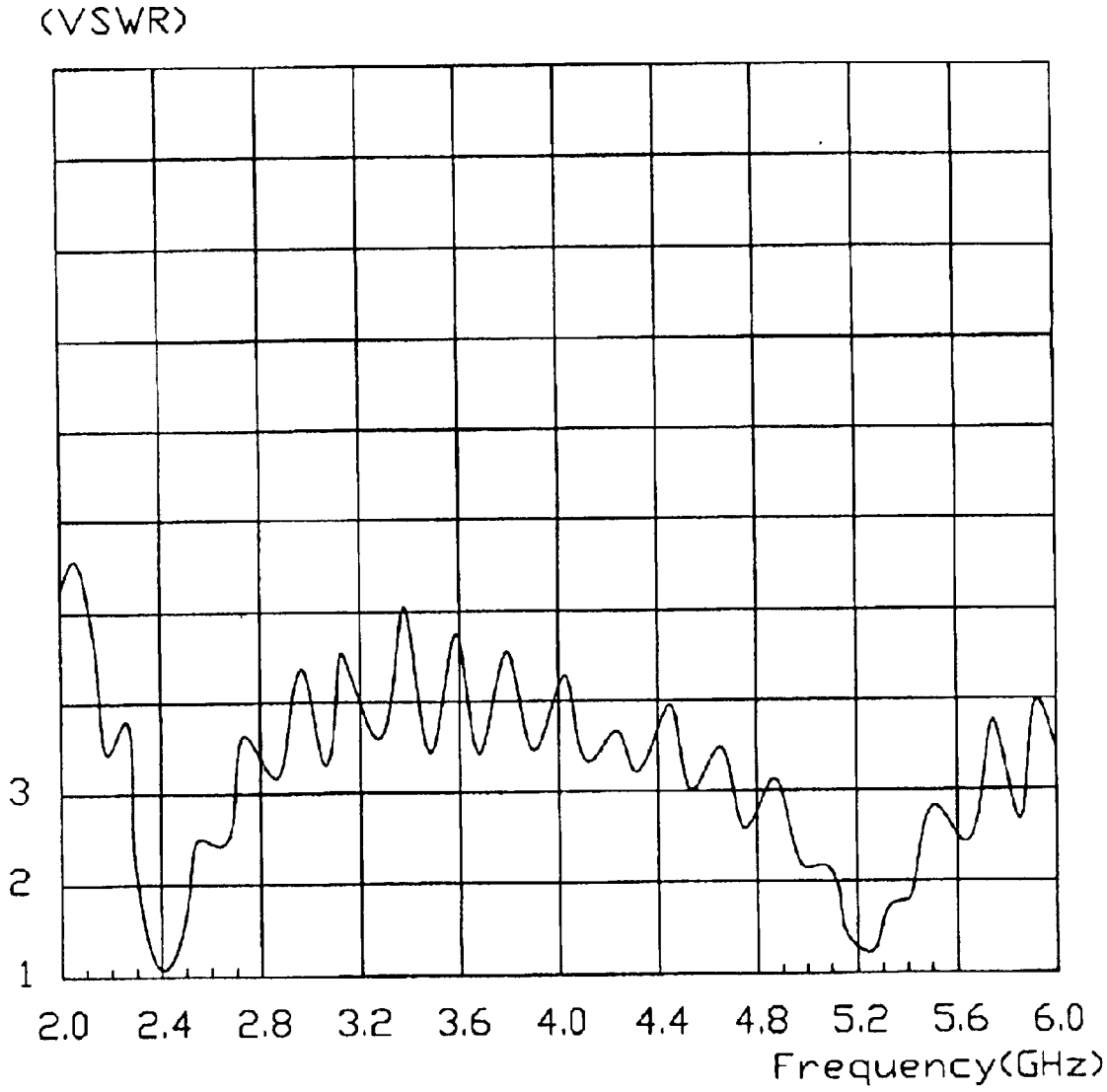
FIG. 8 is a test chart recording for the dual-frequency antenna of FIG. 1, showing Voltage Standing Wave Ratio (VSWR) as a function of frequency.

FIG. 8 shows a test chart recording of Voltage Standing Wave Ratio (VSWR) of the dual-frequency PIFA 1 as a function of frequency. Note that VSWR drops below the desirable maximum value "2" in the 2.45 GHz frequency band and in the 5.25 GHz frequency band, indicating acceptably efficient operation in these two frequency bands. The location of the solder point of the inner core 140 on the first radiating patch 11 is predetermined to achieve a desired matching impedance and an optimal VSWR for both bands.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual-frequency inverted-F antenna (PIFA) for an electronic device, comprising:

a ground plane having a first and second connecting portions extending respectively upwardly from two opposite longitudinal lateral edges of a proximal section of the ground plane;

a first radiating patch attaching to a free end of the first connecting portion and extending longitudinally parallel and opposite to the ground plane; and a second radiating patch attaching to a free end of the second connecting portion and extending longitudinally parallel and opposite to the ground plane, wherein the second radiating patch extends parallel to the first radiating patch;

wherein an assistant edge bends upwardly from the same lateral edge of the ground plane as the connecting portion extending, the first connecting portion connecting with proximal end portion of the assistant edge.

2. A dual-frequency inverted-F antenna (PIFA) assembly for an electronic device, comprising:

a ground plane;

a first radiating patch substantially parallel to the ground plane;

a second radiating patch substantially parallel to the first radiating patch;

a first and second connecting portions respectively connecting the first and second radiating patches with the ground plane; and a coaxial cable feeder comprising a conductive inner core wire, a dielectric layer and a conductive outer shield, wherein the inner core wire is electrically connected to the first radiating patch and the outer shield is electrically connected to the ground plane;

wherein the first and second connecting portions each having a side substantially perpendicular to the ground plane, the first and second radiating patches each having a free end extending beyond corresponding sides of the first and second connecting portions.

3. The dual-frequency PIFA assembly as claimed in claim 2, wherein an aperture is defined between the first and second radiating patches, both in the horizontal and vertical directions.

4. The dual-frequency PIFA assembly as claimed in claim 3, wherein the first radiating patch and the ground plane constitute a first frequency resonant structure, and the first and second radiating patches constitute a second frequency resonant structure.

5. The dual-frequency PIFA assembly as claimed in claim 2, wherein a pair of mounting patches extends downwardly from the ground plane, each mounting patch defining a hole therein.

6. The dual-frequency PIFA assembly as claimed in claim 2, wherein an assistant edge bends upwardly from a lateral edge of the ground plane, the first connecting portion connecting with an end portion of the assistant edge.

7. A dual-frequency inverted-F antenna (PIFA) assembly for an electronic device, comprising;

a ground plane extending in a first direction and defining two opposite lateral sides thereof;

a first connecting portion extending from a portion of one of said two lateral sides in a second direction perpendicular to said first direction and terminating at a distal end thereof;

a second connecting portion extending from a portion of the other of said two lateral sides in a third direction and terminating at a distal end thereof;

a first radiating patch extending from the distal end of the first connecting portion in both the first direction and a fourth direction which is perpendicular to both said first and second directions; and a second radiating patch extending from the distal end of the second connecting portion in both first direction and a fifth direction which is perpendicular to both said first and third directions.

8. The assembly as claimed in claim 7, wherein said first radiating patch and said second radiating patch generally extend toward each other.

9. The assembly as claimed in claim 7, wherein said first radiating patch and said second radiating patch are not aligned with each other in either the second/third direction or the fourth/fifth direction.

10. The assembly as claimed in claim 7, wherein the first connecting portion and the second connecting portion are not aligned with each other in said fourth/fifth direction.

11. The assembly as claimed in claim 10, wherein said first radiating patch is spaced from the grounding plane further than the second radiating patch.

12. The assembly as claimed in claim 11, further including a coaxial cable with a grounding braiding soldered on the grounding plane and an inner conductor soldered on the first radiating patch.

13. The assembly as claimed in claim 12, wherein a solder joint of the grounding braid and the grounding plane is located in alignment with the first connecting portion in the fourth direction.

14. The assembly as claimed in claim 7, wherein the third direction is same as the second direction.

15. The assembly as claimed in claim 7, wherein said filth direction is same as the fourth direction.

16. The assembly as claimed in claim 7, wherein said first connection portion and said second connecting portion are parallel to each other.

* * * * *